US007832822B2

(12) United States Patent
Kiyama et al.

(10) Patent No.: US 7,832,822 B2
(45) Date of Patent: Nov. 16, 2010

(54) INK JET PRINTING APPARATUS AND METHOD FOR CONTROLLING PRINT POSITION ON DEFLECTED PRINT MEDIUM

(75) Inventors: Kota Kiyama, Kawasaki (JP); Takayuki Ninomiya, Ichikawa (JP); Tadashi Matsumoto, Tokyo (JP); Masaaki Naoi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 11/951,892

(22) Filed: Dec. 6, 2007

(65) Prior Publication Data

US 2009/0002424 A1 Jan. 1, 2009

(30) Foreign Application Priority Data

Dec. 8, 2006 (JP) ..... 2006-332108

(51) Int. Cl.
*B41J 29/38* (2006.01)
*B41J 2/155* (2006.01)

(52) U.S. Cl. ..... 347/14; 347/13; 347/43

(58) Field of Classification Search ..... 347/14; 399/40

See application file for complete search history.

(56) References Cited

U.S. PATENT DOCUMENTS 5,589,858 A 12/1996 Kadowaki et al.
5,701,145 A 12/1997 Ninomiya ..... 347/23
6,070,963 A 6/2000 Kamada et al. ..... 347/41
6,591,747 B2 * 7/2003 Buch et al. ..... 347/116
6,648,441 B2 11/2003 Naoi ..... 347/13
6,685,291 B1 2/2004 Naoi ..... 347/12
6,695,504 B2 2/2004 Matsumoto ..... 400/635

(Continued)

FOREIGN PATENT DOCUMENTS

JP 4-226379 8/1992
JP 2003211770 A * 7/2003
JP 2006-192807 7/2006

OTHER PUBLICATIONS

Machine generated translation of specification of patent document JP 2003-211770 A to Tomita; translation generated on Feb. 15, 2010 via http://www.ipdl.inpit.go.jp/homepg_e.ipdl.*

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

A method for controlling a printing position for a printing apparatus for using a plurality of printing heads to print an image is provided. This method prevents, even when a conveyed print medium has deformation such as deflection, a printing position of a print medium from being dislocated. To realize this, components 11 to 14 for detecting the conveyance speed of a print medium and components 101 to 107 adjusting the driving timing at which the respective plurality of printing heads eject ink in accordance with the resultant conveyance speed are provided. As a result, even when a conveyed print medium has deformation such as deflection, the control can be provided that prevents the print medium from having a dislocated printing position.

2 Claims, 10 Drawing Sheets

U.S. PATENT DOCUMENTS 6,783,201 B2 8/2004 Ninomiya ..... 347/8
6,789,888 B2 9/2004 Kiyama ..... 347/104
6,902,254 B2 * 6/2005 Sugaya et al. ..... 347/12
2004/0189784 A1 * 9/2004 Mogi ..... 347/218
2005/0185009 A1 * 8/2005 Claramunt et al. ..... 347/16
2008/0100655 A1 * 5/2008 Furuya et al. ..... 347/14

* cited by examiner

PRIOR ART

PRIOR ART

PRIOR ART

INK JET PRINTING APPARATUS AND METHOD FOR CONTROLLING PRINT POSITION ON DEFLECTED PRINT MEDIUM

BACKGROUND OF THE INVENTION

1. Field of the Invention

The present invention relates to an ink jet printing apparatus. In particular, the present invention relates to the control of a timing at which ink is ejected through a printing head in synchronization with an operating for conveying a print medium.

2. Description of the Related Art

In recent years, digital copiers and printers have been rapidly diffused. Since digital printing system are effective for color adjustment or image processing for example, they have been increasingly used in the field of a color printing apparatus such as a color printer or a color copier. On the other hand, printing apparatuses can be classified to the electronograph one, the ink jet one, or the thermal transfer one for example among which the ink jet printing apparatus is advantageous in that three factors of the cost of the apparatus, the printing quality, and the running cost. Thus, digital color ink jet printing apparatus have been useful in recent years in a range from a low-cost and small apparatus such as a household printer to a large apparatus such as the one for office use.

By the way, more digital cameras have been recently used with a diffusion rate higher than that of silver salt photograph cameras. Thus, large-scale retailers (labo), which conventionally have provided a service for developing silver salt photographs and a print service, recently provide a digital print service for images taken by digital cameras. Such a labo is required a large amount of print output within a short time. Thus, the labo frequently uses an ink jet printing apparatus that continuously conveys a continuous form paper (a print medium wound in a roll-like shape) to eject ink from a long printing head corresponding to the width of the print medium to print an image. The roll paper (continuous form paper) requires a lower cost than that for a cut paper because the manufacture does not require a cut processing and the roll paper can be fed into the apparatus by a simpler mechanism than that for a cut paper. This makes it possible to provide a printed matter with a relatively low cost while reducing the cost for the apparatus itself and the failure frequency. Furthermore, a combination of the use of a long printing head corresponding to the width of a print medium with the continuous feeding of a roll paper can provide a higher printing speed.

FIG. 6 illustrates the outline of a printing apparatus for using a long printing head (hereinafter simply referred to as a printing head) to print an image on a roll paper. A roll paper 6 wound around a rolling body (roll paper rolling body) 5 is disengaged from the rolling body 5 in accordance with the rotation of the rolling body 5 to enter a nip section between a resist roller 7 and an upper resist roller 8. The resist roller 7 and the upper resist roller 8 are rotated while the roll paper 6 being nipped between the upper and lower faces to convey the roll paper 6 to a printing section while correcting the inclination of the roll paper 6.

The downstream side of the resist roller 7 constitutes a printing section in which printing heads 1 to 4 for ejecting ink droplets for printing are arranged to be parallel with one another as shown in the drawing. The printing head 1 ejects cyan ink, the printing head 2 ejects magenta ink, the printing head 3 ejects yellow ink, and the printing head 4 ejects black ink. The respective printing heads 1 to 4 include a plurality of nozzles for ejecting ink that are provided in an amount corresponding to the width of the roll paper 6 in a direction crossing the conveyance direction. At a timing at which the roll paper 6 passes beneath the individual printing heads, ink is ejected from the nozzles of the printing head to form a full color image in a stepwise manner.

The convey path of the printing section includes five spur driving rollers 21 to 25 and five spurs 31 to 35 opposing to the spur driving rollers 21 to 25 as shown in the drawing. These five pairs of rollers function to maintain regions of the roll paper 6 subjected to printing operations by the respective four printing heads 1 to 4 in a flat manner. At the lower side of the regions at which the printing operations by the printing heads 1 to 4 are performed, platens 41 to 44 are provided to maintain distance between a printing surface and the nozzle surfaces of the printing heads while suppressing the roll paper 6 from moving in the downward direction.

At the further downstream of the spur 35, there are a paper ejection roller 9 and an upper paper ejection roller 10 that rotates to follow this paper ejection roller 9 to convey the roll paper 6 to a subsequent step (not shown) such as a cutter.

A speed for conveying the roll paper 6 as described above can be obtained by providing a rotary encoder for detecting the rotation speed of the resist roller 7 for example. In accordance with an output from this encoder, timings at which ink is ejected from the printing heads 1 to 4 can be adjusted to print dots on accurate positions on a roll paper.

FIG. 7 is a schematic diagram specifically describing the structure for adjusting the ejecting timing. In FIG. 7, the resist roller 7, the upper resist roller 8, and the printing head 1 are shown when seen from the conveyance direction of a roll paper. The center axis of the resist roller 7 is fixed to the center of a roller gear 803. The roller gear 803 is connected to a paper feed motor 801 via a driving transmission belt 802. Specifically, the driving force of the paper feed motor 801 is transmitted through the driving transmission belt 802 to rotate the roller gear 803 to further rotate the resist roller 7.

On a tip end of the center axis of the resist roller 7 a rotary encoder 810 is attached. The encoder 810 includes an encoder wheel 811 that is connected to the center axis of the resist roller 7 to rotate together with the resist roller 7 and two encoder sensors Ach 812 and Bch 813 that detect the scale of the encoder wheel 811 from both sides of the center axis.

When the driving force of the paper feed motor 801 is used to rotate the resist roller 7 in a printing operation, the two encoder sensors 812 and 813 output pulse signals TA and TB in synchronization with the scale of the encoder wheel 811 detected by the encoder sensors 812 and 813. If the resist roller 7 and the encoder wheel 811 are assembled with no error at all, the two pulse signals TA and TB are outputted in complete synchronization. However, in an actual case, a small error is always caused in the engagement between the resist roller 7 and the encoder wheel 811 and a position at which the encoder sensor is attached to the encoder wheel 811, thus frequently preventing TA and TB from being in complete synchronization. Consequently, a correction circuit 804 is generally provided that averages the cycles of the two pulse signals TA and TB based on (TA+TB)/2 to obtain an average cycle for generating a new pulse.

A pulse signal outputted from the correction circuit 804 is inputted to an ejecting control circuit 805. Based on the resultant pulse cycle, the ejecting control circuit appropriately controls the ejecting timings of the printing heads 1 to 4 in accordance with the positions of the printing heads 1 to 4.

FIG. 8 is a block diagram illustrating a method by a conventional ejecting control circuit 805 for controlling the ejecting timings of the printing heads 1 to 4. A printing start signal inputted from an input terminal 909 is inputted to the first ejecting timing generator 921 for generating an ejecting timing for the printing head 1. A corrected pulse signal outputted from the correction circuit 804 is also inputted to the first ejecting timing generator 921. Based on the printing start signal inputted from the input terminal, the first ejecting timing generator 921 generates a timing at which the printing head 1 ejects ink while being in synchronization with the pulse signal inputted from the correction circuit 804.

The printing start signal inputted from the input terminal 909 is also inputted to the first delay generator 902. The first delay generator 902 delays the printing start signal in accordance with a distance between the printing head 1 and the printing head 2 and the pulse signal inputted from the correction circuit 804 to output the delayed printing start signal to the second ejecting timing section 922. Based on the printing start signal outputted from the first delay generator 902, the second ejecting timing generator 921 generates a timing signal at which the printing head 2 ejects ink while being in synchronization with the pulse signal outputted from the correction circuit 804. Thereafter, ejecting timing signals for the printing head 3 and the printing head 4 are similarly generated.

By the series of operations as described above, an accurate control of a printing position can be achieved without having an influence by an error related to the conveyance system such as the paper feed motor 801, the roller gear 803, and the driving transmission belt 802.

However, the above structure allows ink to be ejected while in synchronization with a signal of the encoder provided on the axis of the resist roller. Thus, this structure cannot solve a conveyance error due to the eccentricity of the resist roller itself. Furthermore, when a conveyance belt is used to convey the roll paper, an uneven thickness of the conveyance belt also causes variation in the printing position. This problem also cannot be solved by the above structure.

The problem as described above can be solved to a certain level by using the structures disclosed, for example, in Japanese Patent Laid-Open No. 2006-192807 and Japanese Patent Laid-Open No. H04-226379. Japanese Patent Laid-Open No. 2006-192807 discloses a technique to detect an eccentric component in a print medium conveyance system to correct a printing position in accordance with the detected eccentric component. Japanese Patent Laid-Open No. H04-226379 discloses a technique to use a laser Doppler speedometer or the like to detect the conveyance speed of the conveyance belt so that ink can be ejected from a printing head while in synchronization with the resultant conveyance speed.

However, the structure as described with reference to the drawings and the structures as disclosed in Japanese Patent Laid-Open No. 2006-192807 and Japanese Patent Laid-Open No. H04-226379 can correct the error owned by a target mechanism itself but do not directly detect the conveyance status of an actually conveyed print medium. Thus, it has been impossible to suppress a dislocated printing position caused when a roll paper deflects among a plurality of rollers or meanders in conveying or when slippage is caused between a print medium and a roller.

FIGS. 9A and 9B are a schematic diagram illustrating a dislocated printing position caused when the roll paper (print medium) 6 deflects between two pairs of rollers. FIG. 9A shows a status where no deflection is caused. FIG. 9B shows a status where deflection is caused.

When there is no deflection between the two pairs of rollers as shown in FIG. 9A, the roll paper retained between the printing head 1 and the printing head 2 has a length d1 equal to a distance D between two printing heads. However, when deflection is caused between the two pairs of rollers as shown in FIG. 9B, the roll paper retained between the printing head 1 and the printing head 2 has a length d2 that is longer than the distance D between the two printing heads. In this case, a longer time is required for a predetermined position in the roll paper 6 to pass just below the printing head 1 to arrive at a position just below the printing head 2 than in the case where there is no deflection. However, since the conventional structure does not directly detect the conveyance amount of the print medium, the conventional structure does not consider this delayed arrival. As a result, even data for an identical raster position is printed at different positions on a print medium by the printing head 1 and the printing head 2. Specifically, dislocated position is caused on the print medium in the conveyance direction. Thus, dislocated color is caused when different colors are used by the printing head 1 and the printing head 2.

Generally, a roll paper is stored, just before a printing operation, while the printing surface being wound. Thus, a roll paper cannot prevent some winding pattern and thus tends to cause the deflection as described above. However, the conventional method could not directly detect the convey status of an actually conveyed print medium and thus could not avoid an adverse effect due to the deformation of a print medium itself such as the deflection. In addition, the deformation of a print medium is not limited to the roll paper and is caused also by using a cut paper.

SUMMARY OF THE INVENTION

The present invention has been made in order to solve the conventional problem as described above. Thus, it is an objective of the invention to provide a method for controlling a printing position so that, even when a conveyed print medium has deformation such as deflection in a printing apparatus for using a plurality of printing heads to print an image, the printing position is not dislocated on the print medium.

The first aspect of the present invention is an ink jet printing apparatus that includes a conveyance system for conveying a print medium and that uses a plurality of printing heads in which a plurality of printing elements are arranged in a direction different from the direction along which the print medium is conveyed to perform a printing operation, the apparatus comprising: plurality of acquisition device that are provided in the vicinity of the printing heads, respectively, in the conveyance paths of the print medium and that acquire information for a moving speed of the print medium; and adjustment device that adjusts a timing at which the printing heads are driven based on a difference in the moving speed informations acquired by said plurality of acquisition means.

The second aspect of the present invention is an ink jet printing method that uses a conveyance system for conveying a print medium and a plurality of printing heads in which a plurality of printing elements are arranged in a direction different from the direction along which the print medium is conveyed to perform a printing operation, comprising the step of: acquiring information for a moving speed of the printing medium using a plurality of acquisition device that are provided in the vicinity of the printing heads respectively in the conveyance paths; and adjusting a timing at which the printing heads are driven based on a difference in the speed information acquired by said acquiring step.

Further features of the present invention will become apparent from the following description of embodiments (with reference to the attached drawings).

DESCRIPTION OF THE EMBODIMENTS

Hereinafter, embodiments of the present invention will be described in detail with reference to the drawings.

Embodiment 1

Figure 1:
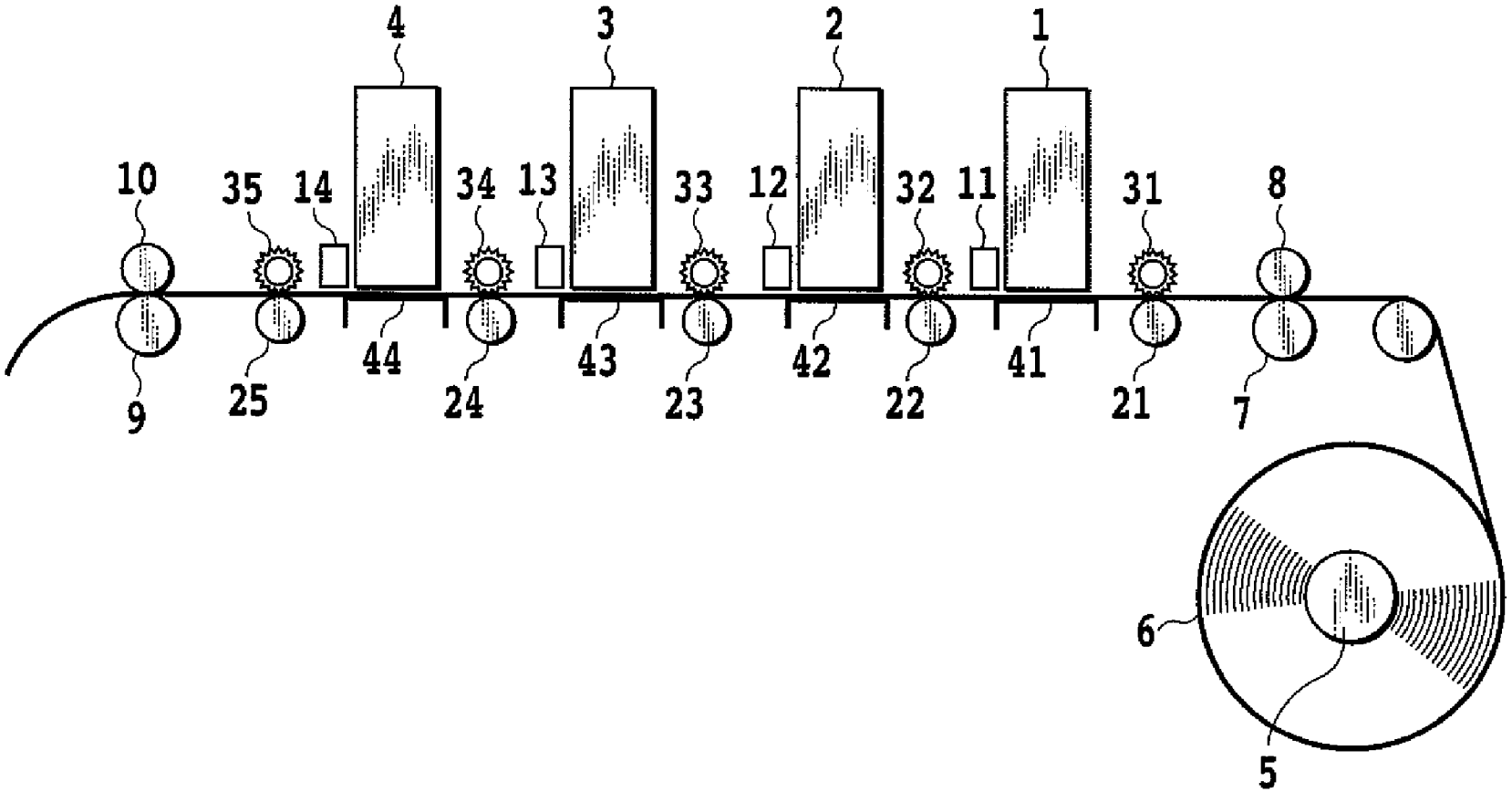
FIG. 1 illustrates the outline of a printing apparatus used in the first embodiment of the present invention in comparison with a conventional example.
Figure 6:
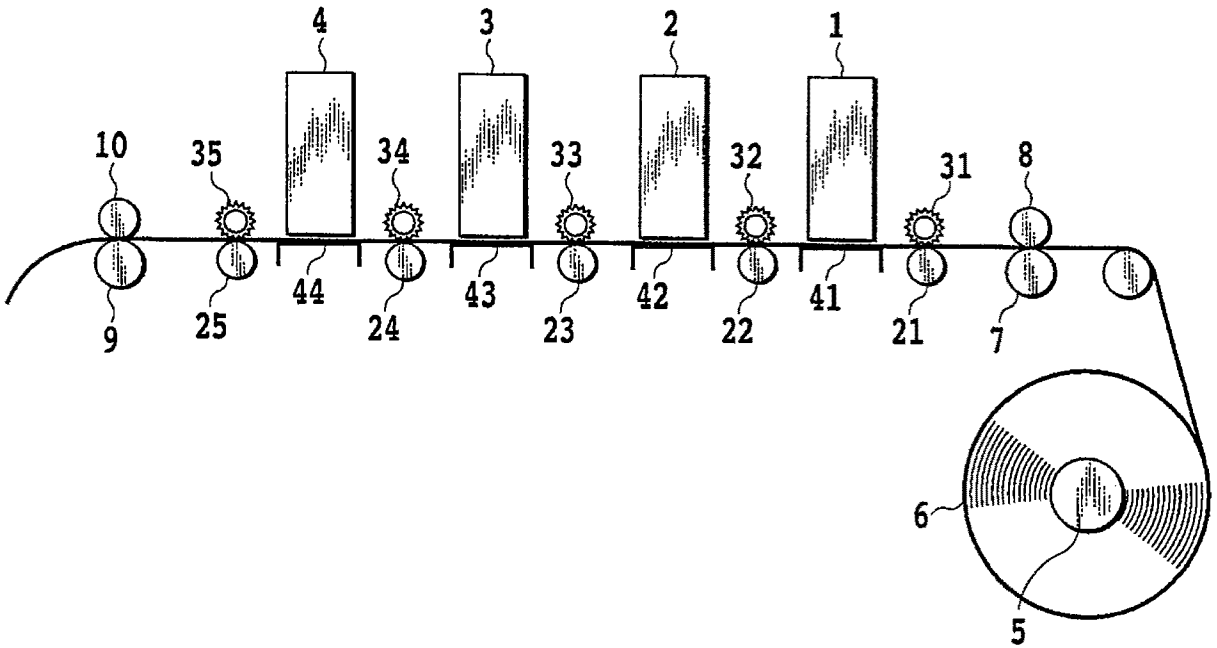
FIG. 6 illustrates the outline of a printing apparatus that uses a printing head to print an image on a roll paper.
Figure 7:
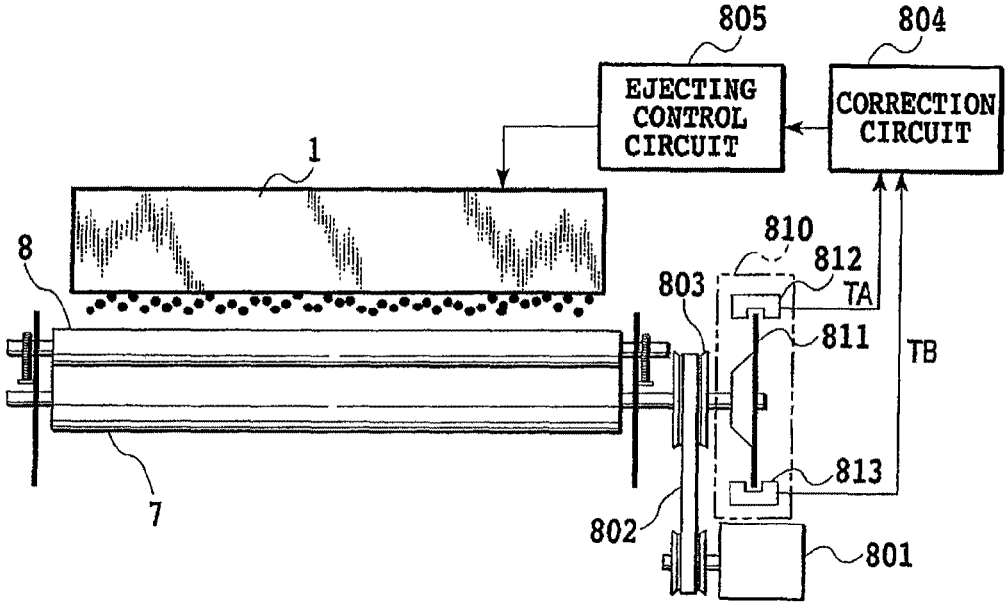
FIG. 7 is a schematic diagram for specifically explaining the structure for adjusting the ejecting timing.

FIG. 1 illustrates the outline of a printing apparatus used in the first embodiment of the present invention in comparison with FIG. 6. This embodiment also uses an ink jet printing apparatus structured so that a plurality of printing heads 1 to 4 including a plurality of printing elements in a direction crossing the conveyance direction are arranged in the conveyance direction with a fixed interval thereamong. The printing heads 1 to 4 eject black, cyan, magenta, and yellow ink, respectively. In FIG. 1, those members denoted with the same reference numerals as those in FIG. 6 represent the same members as those of a conventional printing apparatus. This embodiment is characterized in that speed detectors 11 to 14 are provided in the vicinity of the printing heads 1 to 4. The speed detectors 11 to 14 detect a conveyance speed of a roll paper as a print medium. The speed detector 11 detects the conveyance speed of the roll paper 6 in the vicinity of the printing head 1. This roll paper 6 is fed by the rotation of the rolling body 5 and is conveyed by the conveyance roller 7 to a printing position provided in the conveyance path. The speed detector 12 detects the conveyance speed of the roll paper 6 in the vicinity of the printing head 2. The speed detector 13 detects the conveyance speed of the roll paper 6 in the vicinity of the printing head 3. The speed detector 14 detects the conveyance speed of the roll paper 6 in the vicinity of the printing head 4. The respective speed detectors 11 to 14 include laser Doppler speedometers 300.

Figure 2:
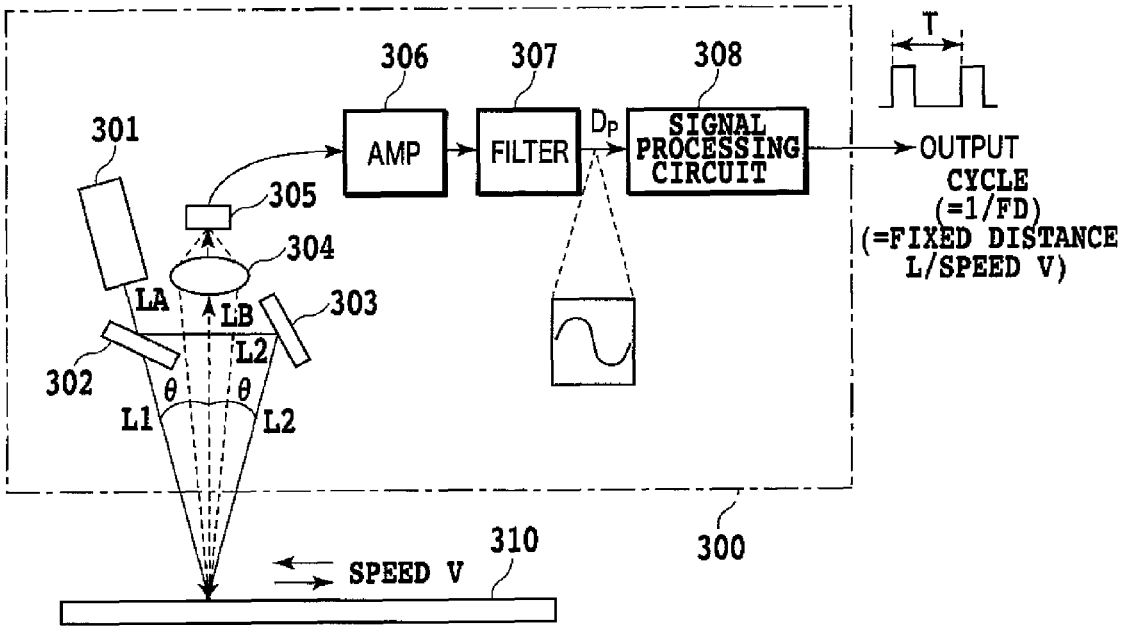
FIG. 2 is a schematic diagram illustrating the structure of a laser Doppler speedometer.

FIG. 2 is a schematic diagram illustrating the structure of a laser Doppler speedometer 300. The laser Doppler speedometer (speed measurement section) 300 includes, as an optical system mechanism, a laser light source 301, a beam splitter 302, a reflection mirror 303, a collecting lens 304, and a light-receiving sensor 305. The laser light LA emitted from the laser light source is divided by the beam splitter 302 to proceed in two directions. One light beam L1 passes the beam splitter 302 to enter a roll paper as a to-be-measured object 310 with an incidence angle θ. The other light beam L2 reflected by the beam splitter 302 proceeds to a reflection mirror 303. The laser light L2 reflected by the reflection mirror 303 enters the to-be-measured object 310 with an incidence angle θ in a direction opposite to the direction of L1.

When the laser lights L1 and L2 enter a to-be-printed object 310 (roll paper), the laser lights L1 and L2 are scattered by the to-be-printed object 310 (roll paper) conveyed at a predetermined speed. Then, scattered light LB is collected by the collecting lens 304 and is detected by the light-receiving sensor 305. Then, the light is subjected to photoelectric conversion by the light-receiving sensor 305. Then, the light-receiving sensor 305 outputs an electric signal in accordance with the amplitude of the received light. The amplitude of the outputted electric signal is amplified by an amplifier 306 and is subjected to heterodyne detection by a band-pass filter 307. As a result, a Doppler signal $D_p$ as an analog signal is obtained. This Doppler signal $D_p$ is a beat signal electrically extracted caused when the two laser lights L1 and L2 are scattered by the to-be-measured object 310 moving with a speed V.

This will be described specifically. When assuming that the to-be-measured object 310 has the speed V, the light beams L1 and L2 have an incidence angle θ, and the laser light has a wavelength λ, the Doppler signal $D_p$ has a frequency fD that can be represented as follows.

$$fD=2V\cdot\sin\theta/\lambda \tag{1}$$

Thus, even when the speed V of the to-be-measured object 310 changes, a detected fD, a previously determined incidence angle θ and a laser light wavelength λ can be used to know the speed V of the to-be-measured object 310 on the real time basis.

In this embodiment, the Doppler signal $D_p$ is further inputted to a signal processing circuit 308 where the Doppler signal $D_p$ is converted to a pulse signal having the same frequency fD as that of the Doppler signal $D_p$. Then, the pulse signal outputted from the signal processing circuit 308 has a cycle T that can be represented as follows.

$$T(=1/fD) \tag{2}$$

The above formulae (1) and (2) can be used to calculate the cycle T as follows.

$$T=\lambda/(2V\cdot\sin\theta) \tag{3}$$

Thus, the to-be-measured object 310 is in inverse proportion to the speed V. The above formula (3) can be modified to the following formula.

$$T\cdot V=\lambda/(2\cdot\sin\theta) \tag{4}$$

This shows that a multiplication value of the speed V and the cycle T has a dimension of the length (distance) and the length (i.e., λ/(2·sin θ)) is a fixed value (L) that is determined based on the design specification of the laser Doppler speedometer 300. Thus, the fixed value L is defined in the following formula.

$$L=\lambda/(2\cdot\sin\theta)) \tag{5}$$

In the above formula, the cycle T of the pulse signal is a time required for the to-be-measured object 310 to proceed along the fixed distance L. In other words, whenever the to-be-measured object 310 proceeds the fixed distance L, a rising edge of a pulse signal is generated from the signal processing circuit 308. When the laser wavelength $\lambda$=800 nm and the sin $\theta$=¼ for example, then the fixed distance L in this case is 1.6 μm. Thus, the displacement of the rising edge of the pulse signal is detected for every L=1.6 μm, thereby realizing a very accurate speedometer.

Figure 3:
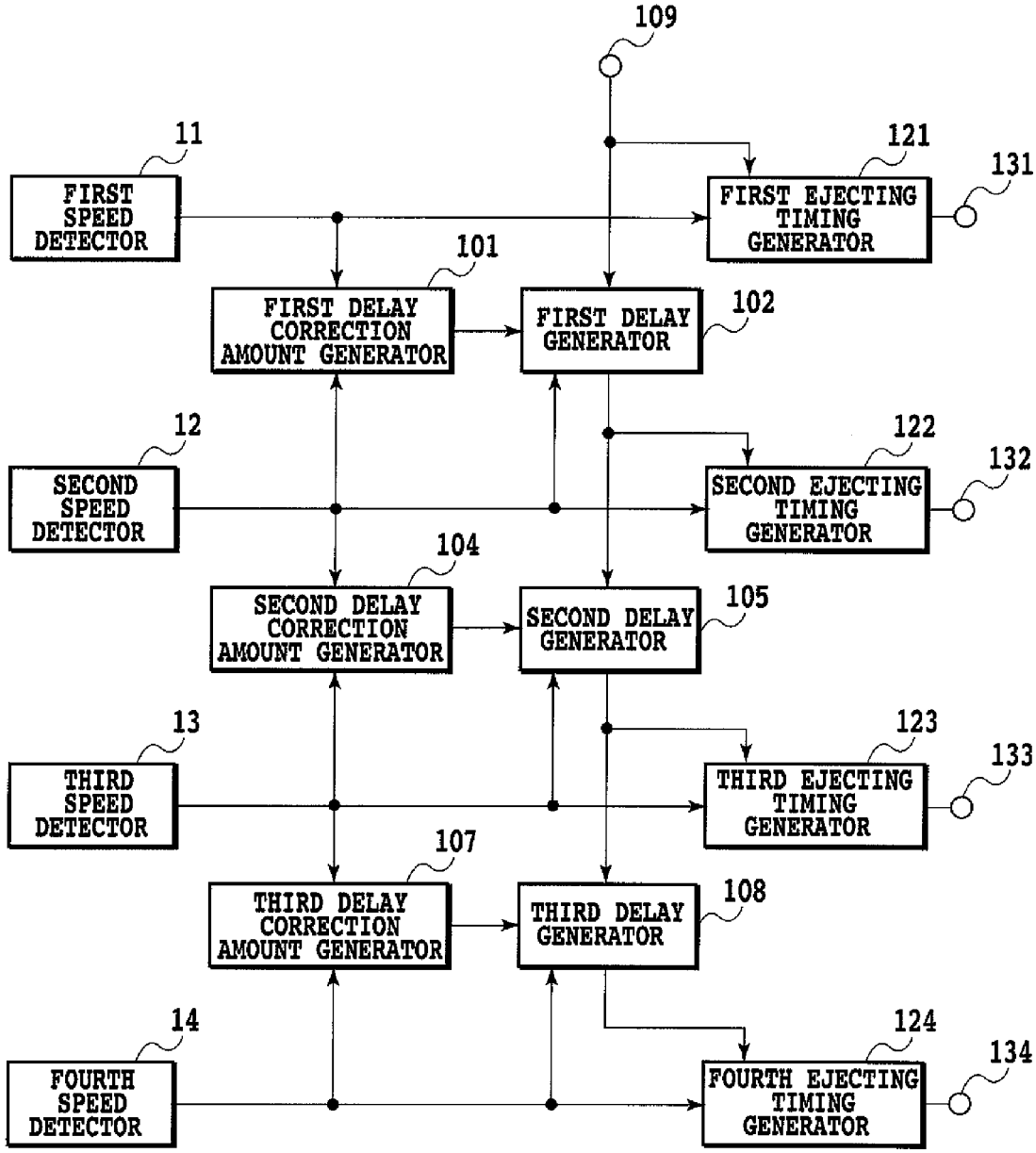
FIG. 3 is a block diagram illustrating a method for controlling an ejecting timing in an embodiment 1.
Figure 8:
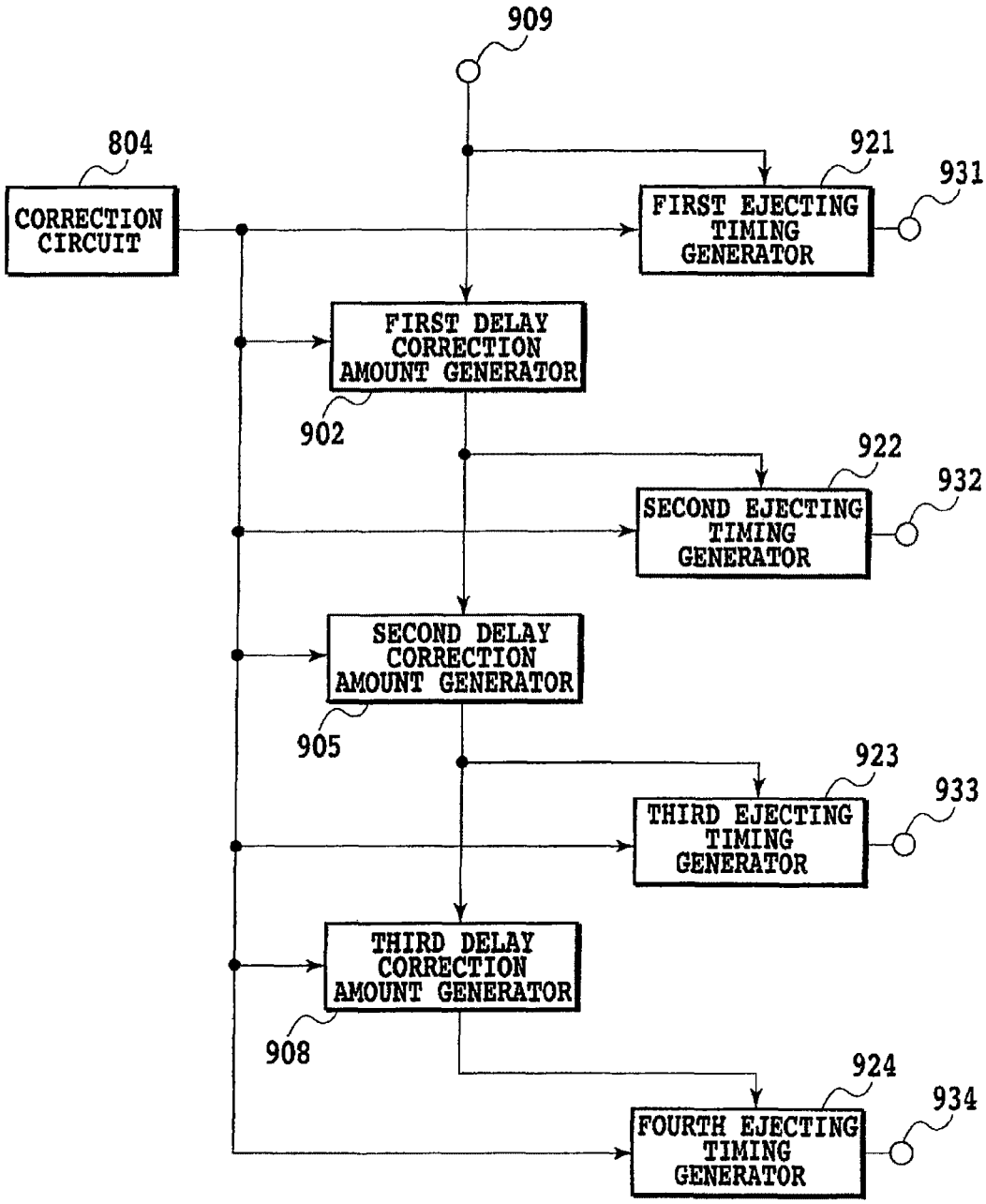
FIG. 8 is a block diagram illustrating a method for controlling the ejecting timings of the printing heads 1 to 4 in a conventional ejecting control circuit 805.

FIG. 3 is a block diagram illustrating the method for controlling an ejecting timing of this embodiment in comparison with FIG. 8.

The printing start signal inputted from the input terminal 109 is inputted to the first ejecting timing generator 121 that generates the ejecting timing of the printing head 1. The pulse signal that is outputted from the first speed detector 11 and that has a cycle corresponding to the roll paper conveyance speed V is also inputted to the first ejecting timing generator 121. The first ejecting timing generator 121 generates, based on the printing start signal inputted from the input terminal, a driving timing signal for causing the respective printing elements of printing head 1 to eject ink while being in synchronization with the pulse signal inputted from the first speed detector 11. This will be described further. The printing data is read from a printing buffer (not shown) on the basis of one raster. This read printing data is transferred to the printing head.

Figure 9A:
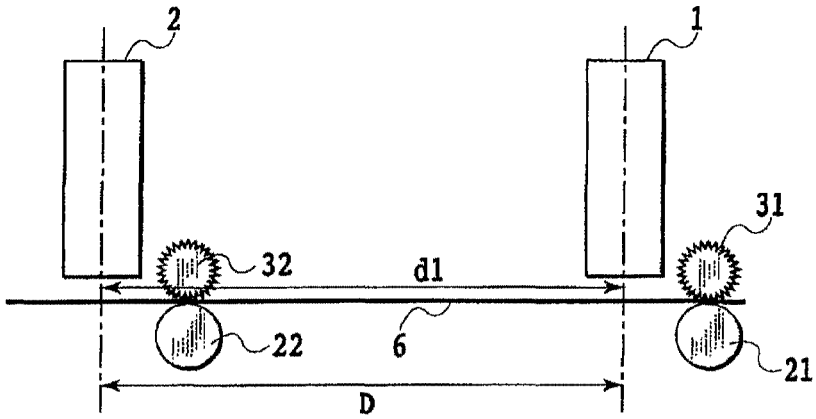
PRIOR ART FIG.9A
FIGS. 9A and 9B are a schematic diagram illustrating a dislocated printing position when a deflected print medium is caused between two pairs of rollers.
Figure 9B:
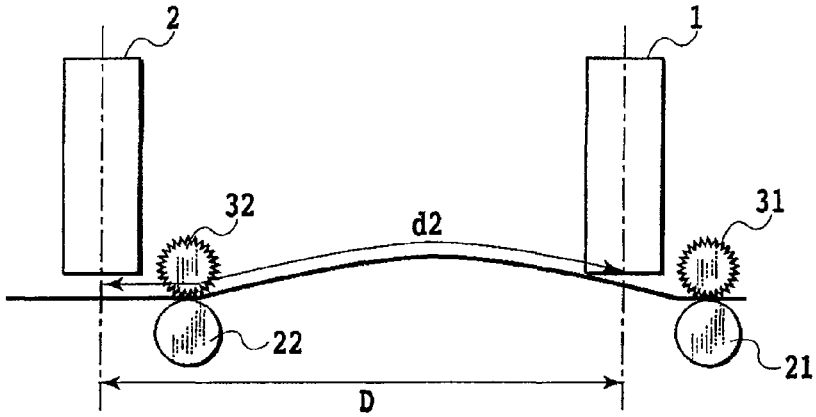

On the other hand, the first to third delay correction amount generators 101, 104, and 107 are composed of counter circuits. The first delay correction amount generator 101 will be exemplarily described. When a pulse signal is inputted from the first speed detection means 11 to the first delay correction amount generator 101, the count value is incremented. When a pulse signal is inputted from the second speed detection means 12 to the first delay correction amount generator 101, the count value is decremented. Thus, in a process as shown in FIG. 9B where the deflection is generated for example, the conveyance speed V detected by the first speed detector 11 is higher than the conveyance speed V detected by the second speed detection means 12. Thus, the count value of the first delay correction amount generator 101 is gradually increased. In a process in which the deflection is reduced on the other hand, the conveyance speed V detected by the second speed detector 12 is higher than the conveyance speed V detected by the first speed detector 11. Thus, the count value of the first delay correction amount generator 101 is gradually reduced.

The first delay correction amount generator 101 periodically outputs this count value (corrected value) to the first delay generator 102. This cycle is based on the conveyance speed of a print medium for example. The first delay generator 102 retains information for a distance in the conveyance direction between the printing head 1 and the printing head 2. The first delay generator 102 delays, based on the correction amount inputted from the count generator 101 and the information for the distance between the printing head 1 and the printing head 2, the printing start signal obtained from the input terminal to output the signal to the second ejecting timing generator 122. The second ejecting timing generator 122 generates, based on the printing start signal outputted from the first delay generator 102, a timing signal for causing the printing head 2 to eject ink. By delaying the printing start signal to the printing head 2, the printing by the printing head 2 can be performed at the position printed by the printing head 1.

Figure 10A:
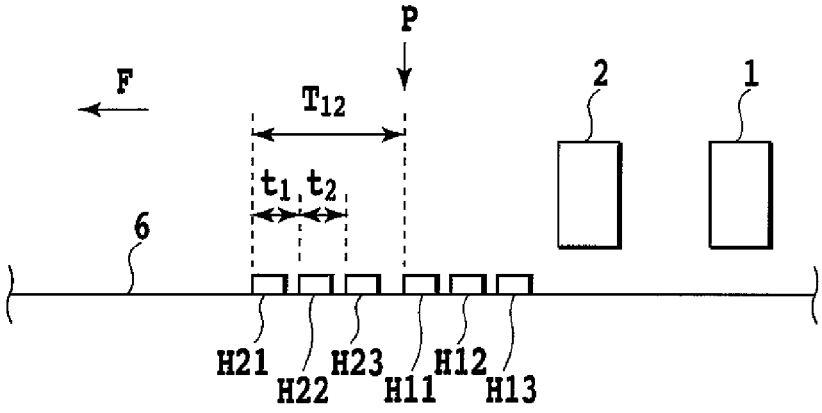
FIGS. 10A and 10B are a schematic diagram illustrating a method for controlling the ejecting timing in the embodiment 1.
Figure 10B:
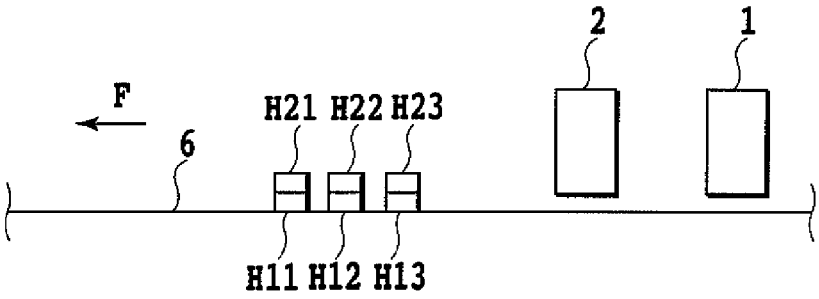

FIGS. 10A and 10B are a schematic cross section diagram of conveyance system for illustrating the control of the ejecting timing in the embodiment 1. In order to simplify the description of the control, a case will be described where the printing of image data for three rasters is performed. In the figure, print is performed on the print medium 6 conveyed for the direction indicated an arrow F. P shows a position at which the first raster of the printing head 1 is printed. This position P is based on the printing start signal inputted from 109 of FIG. 3.

FIG. 10A shows that an influence by the deflection causes the dislocation of the printing position by the printing head 1 and the printing position by the printing head 2 that corresponds to the time T12. For simpler explanation, the dislocation of the printing position is exaggerated. H11 represents an image of the first raster printed by the printing head 1, H12 represents an image of the second raster printed by the printing head 1, and H13 represents an image of the third raster printed by the printing head 1, respectively. H21 represents an image of the first raster printed by the printing head 2, H22 represents an image of the second raster printed by the printing head 2, and H23 represents an image of the third raster printed by the printing head 2, respectively.

FIG. 10B illustrates a case where the printing start signal of the printing head 2 is delayed by the second ejecting timing generator 122. The first delay generator 102 performs a processing for delaying the timing of the printing start signal inputted from 109 by the time T12 (adjustment processing). By this processing, the dislocation of the printing position by the printing head 1 and the printing position by the printing head 2 can be solved.

The second ejecting timing generator 122 performs, in synchronization with the signal outputted from the second speed detector 12, the driving of the printing head based on the printing timing signal. This will be described with reference to FIG. 10A. The interval (t1) between the timing at which the first raster is printed and the timing at which the second raster is printed and the interval (t2) between the timing at which the second raster is printed and the timing at which the third raster is printed are adjusted.

The third ejecting timing generator 123 for generating the timing at which ink is ejected from the printing head 3 generates a timing signal for causing the printing start signal outputted from the first delay generator 102 is inputted to cause the printing head 3 to eject ink. Specifically, the delayed timing information of the printing head provided at the upstream is used to generate a timing at which ink is ejected. This processing is also applicable to the fourth ejecting timing generator 124.

According to this embodiment, the ejecting timings of the individual printing heads are corrected in accordance with an actual conveyance speed of the roll paper while measuring the conveyance speed of a roll paper positioned in the vicinity of the respective plurality of printing heads on the real-time basis. This can realize a highly accurate control of the printing position while suppressing the dislocated printing by a plurality of printing heads for not only a case where an error related the convey mechanism itself is included but also a case where the roll paper is deflected for example.

Embodiment 2

Figure 4:
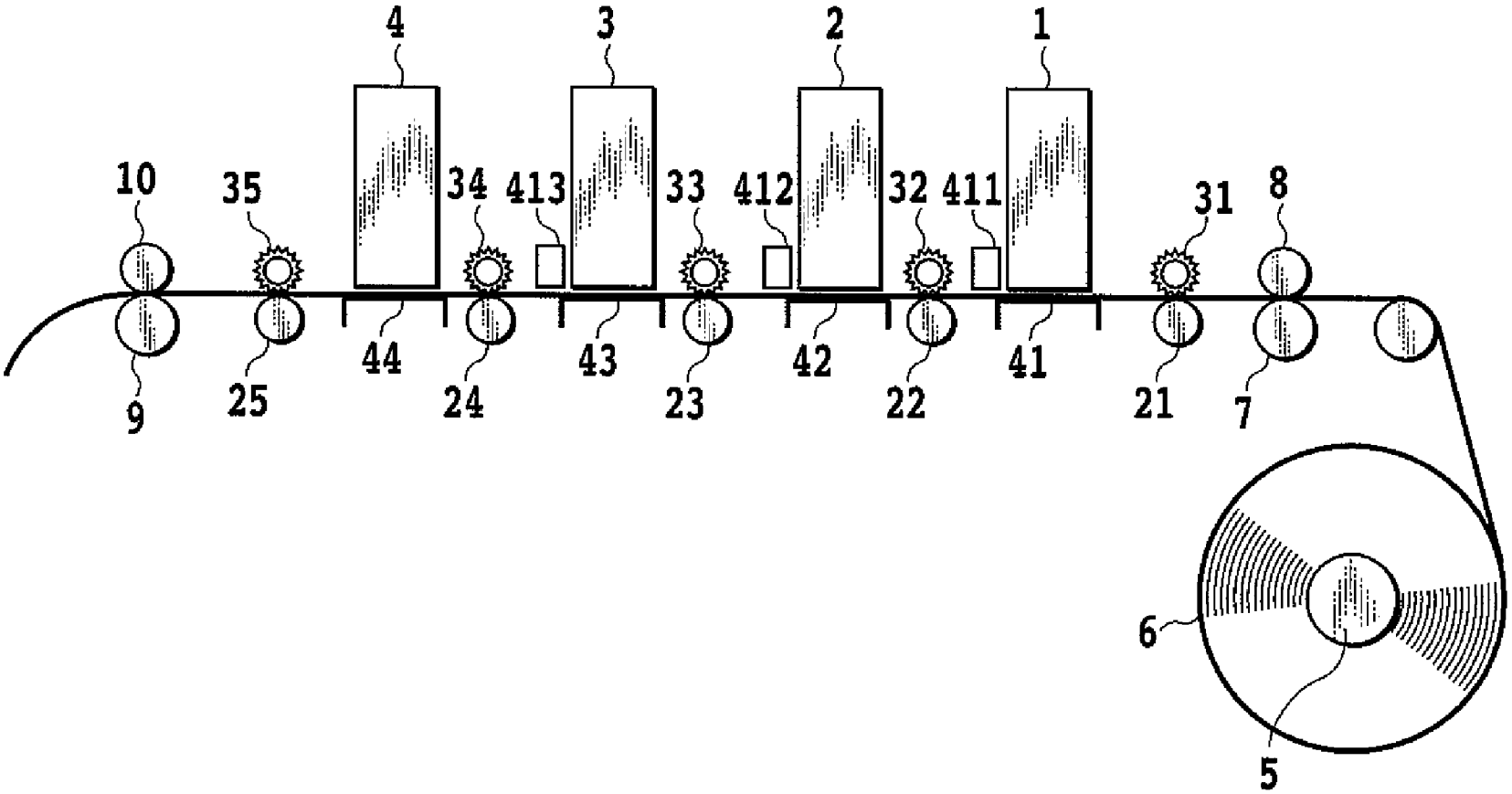
FIG. 4 illustrates the outline of a printing apparatus used in an embodiment 2.

FIG. 4 shows the structure of a printing apparatus used in the second embodiment of the present invention in comparison with FIG. 6 or FIG. 1. In FIG. 4, the same members as those of FIG. 6 denote the same members as those of a conventional printing apparatus. This embodiment is characterized in that three positions adjacent to the printing head 1, the printing head 2, and the printing head 3 have speed detectors 411, 412, and 413 having the same structure as those of the first embodiment. The second embodiment is different from the first embodiment in an order of the colors printed by the printing heads. Specifically, the printing head 1 ejects black ink, the printing head 2 ejects cyan ink, and the printing head 3 ejects magenta ink, and the printing head 4 ejects yellow ink. Even when the deflection is caused between the printing head 3 and the spur 34, yellow ink ejected from the printing head 4 has small dislocation that is not conspicuous. Thus, a speed detector corresponding to the printing head 4 is omitted. This also applies to inks of colors, if a dislocation is not conspicuous, other than yellow such as light cyan and light magenta. By reducing the number of speed detectors by one, reduced cost and a reduced apparatus size can be achieved.

Figure 5:
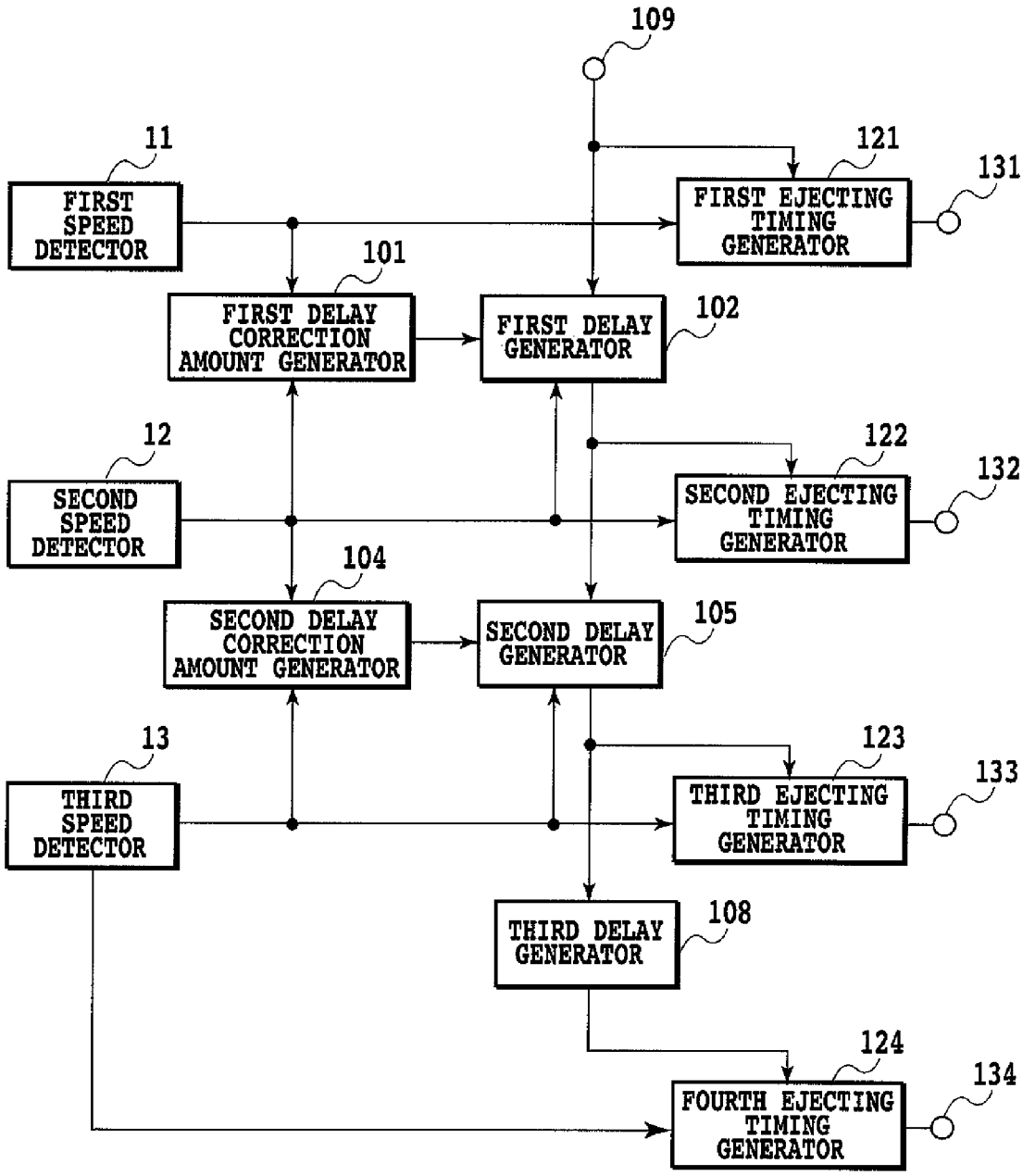
FIG. 5 is a block diagram illustrating a method for controlling an ejecting timing of the embodiment 2.

FIG. 5 is a block diagram illustrating a method for controlling an ejecting timing of this embodiment in comparison with FIG. 8 or FIG. 3.

FIG. 5 will be described with regards to the difference from FIG. 3. In FIG. 5, the same contents as those of FIG. 3 will not be described further.

FIG. 5 is difference from FIG. 3 in that the fourth speed detector 14 is not provided and thus the third delay generator 108 inputs information from the second delay generator 105. The fourth ejecting timing generator 124 performs printing using a signal from the third speed detector 13. Specifically, information for the movement of the print medium detected by the speed detector adjacent to the neighboring printing head is used.

As described above, according to this embodiment, if the dislocation of color ink used in the printing is at a negligible level, a structure can be used where a speed detector for measuring the conveyance speed of a print medium on the real-time basis is omitted.

While the present invention has been described with reference to embodiments, it is to be understood that the invention is not limited to the disclosed embodiments. The scope of the following claims is to be accorded the broadest interpretation so as to encompass all such modifications and equivalent structures and functions.

The application claims the benefit of Japanese Patent Application No. 2006-332108, filed Dec. 8, 2006, which is hereby incorporated by reference herein in its entirety.

What is claimed is:

1. An ink jet printing apparatus having a conveyance system for conveying a print medium along a first direction comprising:

a first printing head of an ink jet type in which a plurality of printing elements are arranged in a second direction different from the first direction;

a second printing head of an ink jet type in which a plurality of printing elements are arranged in the second direction, provided at a downstream side with respect to the first printing head in the first direction;

a third printing head of an ink jet type in which a plurality of printing elements are arranged in the second direction, provided at a downstream side with respect to the second printing head in the first direction;

a fourth printing head of an ink jet type in which a plurality of printing elements for ejecting yellow ink are arranged in the second direction, provided at a downstream side with respect to the third printing head in the first direction;

a first pair of rollers, provided at a upstream side with respect to the first printing head, that nips and conveys the print medium;

a second pair of rollers, provided between the first printing head and the second printing head with respect to the first direction, that nips and conveys the print medium;

a third pair of rollers, provided between the second printing head and the third printing head with respect to the first direction, that nips and conveys the print medium;

a fourth pair of rollers, provided between the third printing head and the fourth printing head with respect to the first direction, that nips and conveys the print medium;

a fifth pair of rollers, provided at a downstream side with respect to the fourth printing head, that nips and conveys the print medium;

a first Doppler speedometer that acquires a moving speed of the print medium at a position between the first printing head and one of the second pair of rollers;

a second Doppler speedometer that acquires a moving speed of the print medium at a position between the second printing head and one of the third pair of rollers;

a third Doppler speedometer that acquires a moving speed of the print medium at a position between the third printing head and one of the fourth pair of rollers; and a control unit that controls drive timings of the first, the second, the third, and the fourth printing heads, wherein the first printing head is driven based on a moving speed acquired by the first Doppler speedometer, the second printing head is driven based on a difference in the moving speeds acquired by the first and the second Doppler speedometers, the third printing head is driven based on a difference in the moving speeds acquired by the second and the third Doppler speedometers, and the fourth printing head is driven based on a moving speed acquired by the third Doppler speedometer, wherein a Doppler speedometer is not provided corresponding to the fourth printing head.

2. The ink jet printing apparatus according to claim 1, wherein the print medium is a roll paper.

* * * * *